United States Patent [19]

Masaka et al.

[11] Patent Number: 4,929,813

[45] Date of Patent: May 29, 1990

[54] GLOW PLUG FOR DIESEL ENGINE

[75] Inventors: Mitusuke Masaka; Koji Hatanaka; Kenji Maruta; Seiji Okazaki, all of Saitama, Japan

[73] Assignees: Jidosha Kiki Co., Ltd.; Hitachi Metals, Ltd., both of Tokyo, Japan

[21] Appl. No.: 199,383

[22] Filed: May 27, 1988

[30] Foreign Application Priority Data

May 28, 1987 [JP] Japan ..... 62-132085

[51] Int. Cl.[5] ..... F23Q 7/22; F02P 19/02; H05B 3/00

[52] U.S. Cl. ..... 219/270; 123/145 A; 219/541; 219/553

[58] Field of Search ..... 219/260, 270, 552, 553, 219/544, 541; 123/145 R, 145 A

[56] References Cited

U.S. PATENT DOCUMENTS

| | | | |
|---|---|---|---|
| 4,475,029 | 10/1984 | Yoshida et al. | 123/145 A X |
| 4,653,443 | 3/1987 | Fukazawa et al. | 219/270 X |
| 4,806,734 | 2/1989 | Masaka et al. | 219/270 |
| 4,810,853 | 3/1989 | Maruta et al. | 219/270 |

FOREIGN PATENT DOCUMENTS

| | | | |
|---|---|---|---|
| 3707814 | 9/1987 | Fed. Rep. of Germany | 219/270 |
| 58-62427 | 4/1983 | Japan | 219/270 |
| 59-176517 | 10/1984 | Japan | 219/270 |

*Primary Examiner*—Anthony Bartis

*Attorney, Agent, or Firm*—Blakely, Sokoloff, Taylor & Zafman

[57] ABSTRACT

A diesel engine glow plug having an elongated hollow electrically conductive holder, which holds a rod-like ceramic heater at one end thereof such that one end of the heater extends outside the holder. An external connecting terminal is positioned in the other end of the hollow holder and electrically insulated from the hollow holder. The ceramic heater is a U-shaped heating element with a pair of parallel lead portions made of a resistive ceramic material extending backward from both ends of the U-shaped heating element and arranged such that the outer surfaces of the lead portions are held by the distal end of the holder through electrical insulating layers between the inner surface of the holder and the outer surface of the lead portions. The rear end portions of the lead portions are electrode extraction ends wherein the electrode extraction end of one lead portion is electrically connected to the external connecting terminal through a conductive material and the electrode extraction end of the other lead portion is connected to the metal pipe which itself is electrically connected to the holder through a conductive material.

8 Claims, 1 Drawing Sheet

GLOW PLUG FOR DIESEL ENGINE

BACKGROUND OF THE INVENTION

The present invention relates to a glow plug for preheating a subcombustion or combustion chamber of a diesel engine and, more particularly, to an improvement of a diesel engine glow plug having a ceramic heater which has fast heating and self temperature saturation properties and which allows "after glow" operation for a long period of time.

Conventional glow plugs having various types of structures have been proposed. Among these glow plugs, a plug having a ceramic heater has received a great deal of attention as a fast heating plug.

A plug of a ceramic heater type is described in Japanese Patent Laid-Open No. 60-14784. In this glow plug, a resistive ceramic material having substantially the same thermal expansion coefficient as that of an insulating ceramic material constituting a heater insulating element is used. A heating element is exposed on the outer surface of a heater and the heating element is integrally formed with the heater insulating element. With this structure, the distal end of the heater can be immediately heated to obtain a fast heating glow plug. At the same time, bonding between the heating element and the heater insulating element can be optimally and appropriately maintained to improve reliability for heat resistance or the like to some extent.

In a conventional glow plug of a ceramic heater type having the structure as described above, however, many problems are left unsolved from the structural and functional points of view when such a plug is used as a practical glow plug.

With the above structure, the heating element is exposed on the surface of the heater. Although this heater serves as a fast heating heater to some extent, the heating element has a U-shaped laminated construction and both ends are guided to the rear end portion of the heater. In order to prepare a practical heater, a special care must be paid to the structures of electrode extraction portions and a holding portion for a holder. For example, the simplest method of extracting electrodes from a U-shaped ceramic heater is to externally connect one of the lead portions through an external connecting terminal kept insulated from the rear end portion of the holder and to ground the other lead portion through a conductive layer such as a metallized layer formed on the holding portion fitted in the holder. When the above structure is employed, an insulating layer such as an insulating coating layer must be formed on the holding portion of one lead portion which is to be fitted in the holder, so that the holding portion is kept insulated. In this case, the thickness of the insulating layer must be 20 μm or more. This thickness is larger than the thickness of the conductive layer (i.e., the thickness of the conductive layer is 5 μm or less). It is difficult or time-consuming to form these layers on the corresponding lead portion. In addition, since the layers having different thicknesses are formed, it is difficult to coaxially fit the lead portion in the holder, thus causing assembly problems.

The portion to be connected to the holder through such conductive and insulating layers must have high heat resistance and good hermetic seal free from a thermal influence as well as high electrical conductivity and insulating properties. In this manner, many quality check items are required for the lead holding portion. It is difficult to obtain lead holding portions having uniform quality. Nonuniform quality poses many practical problems. Demand has arisen for developing a glow plug having a ceramic heater, fast heating and self temperature saturation properties, and high reliability such as high heat resistance.

SUMMARY OF THE INVENTION

It is, therefore, an object of the present invention to provide a glow plug having a ceramic heater, fast heating and self temperature saturation properties, and high reliability such as high heat-resistance.

In order to achieve the above object of the present invention, there is provided a glow plug for a diesel engine. The glow plug comprises a hollow holder; a rod-like ceramic heater held at a distal end of the hollow holder such that one end of the rod-like ceramic heater extends outside; and an external connecting terminal held at the other end of the hollow holder such that the external connecting terminal is kept insulated from the hollow holder. The ceramic heater is provided with a U-shaped heating element and a pair of parallel lead portions extending backward from both ends of the U-shaped heating element. The U-shaped heating element and the pair of parallel lead portions are made of a resistive ceramic material and are arranged such that outer surfaces of the lead portions are held by the distal end of the holder through insulating layers, rear end portions of the lead portions constituting electrode extraction ends and being separated from the holder in the holder. The electrode extraction end of one lead portion is connected to the external connecting terminal through a conductive material, and the electrode extraction end of the other lead portion is connected to part of an inner wall surface of the holder through a conductive material.

According to the present invention, an insulating layer such as an insulating coating layer is formed on part of an outer surface of a lead portion of a ceramic heater, and this insulating layer portion is bonded to the distal end of the holder by brazing or the like. At the same time, one lead portion is connected to an external connecting terminal kept insulated at the rear end portion, and the other lead is grounded to the holder, thereby constituting a glow plug.

DESCRIPTION OF THE PREFERRED EMBODIMENTS

Preferred embodiments of the present invention will be described with reference to the accompanying drawings.

Figure 1:
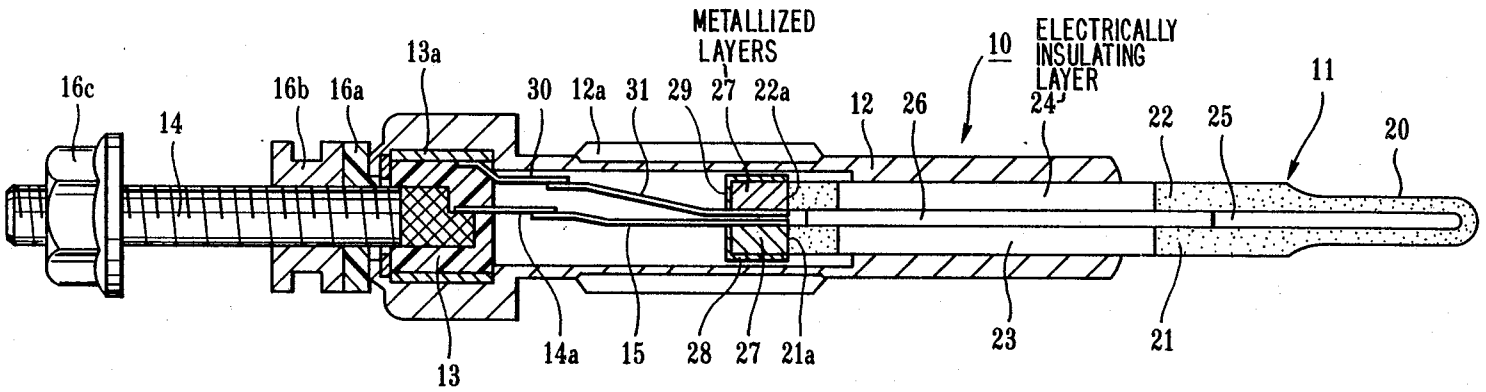
FIG. 1 is a longitudinal sectional view of a glow plug of a diesel engine according to an embodiment of the present invention.

FIG. 1 shows a diesel engine glow plug according to an embodiment of the present invention. The overall arrangement of a glow plug denoted by reference numeral 10 will be briefly described. The glow plug 10 comprises a rod-like ceramic heater 11 whose distal end portion serves as a heating element and a tubular metal holder 12 for holding the heater 11 at its distal end. An external connecting terminal 14 is coaxially held in a rear end portion of the holder 12 through an insulating bushing 13 made of a synthetic resin material. The external connecting terminal 14 is connected to one lead portion (to be described later) by a resistive ceramic material constituting the ceramic heater 11 through a terminal piece 14*a* and a metal wire 15. Reference numeral 13*a* denotes a metal pipe fitted on the insulating bushing 13. The metal pipe 13*a* is axially deformed by a high pressure acting on the larger end portion of the holder 12 during assembly, thereby mounting the insulating bushing 13 to the holder 12 with a predetermined mechanical strength.

Reference numerals 16*a*, 16*b*, and 16*c* denote an insulating ring, a fixing nut, and an external lead fastening nut, all of which are threadably engaged with threads of the rear end portion of the external connecting terminal 14. A lead wire or the like from a battery (not shown) is clamped between the rear end portion of the external connecting terminal 14 and the nuts 16*b* and 16*c*, thereby electrically connecting the external connecting terminal 14 to the battery terminal. Reference numeral 12*a* denotes threads formed on the outer surface of the holder 12*a*. The threads 12*a* are engaged with the threads of an engine cylinder head (not shown), so that the distal end portion of the heater 11 extends inside a subcombustion chamber (or combustion chamber). The metal wire 15 may be a wire (e.g., a flexible wire) having some flexibility so as to protect the heater 11 from mechanical external forces such as various vibrations acting on the external connecting terminal 14 and protect the heater 11 from the fastening torque. A plate member formed integrally with a terminal cap (to be described later) may be used for this purpose.

In the glow plug having the above structure according to the present invention, the rod-like ceramic heater 11 held at the distal end of the holder 12 comprises a U-shaped heating element 20 and a pair of parallel lead portions 21 and 22 extending from both ends of the U-shaped heating element 20, thus constituting a U-shaped assembly, as shown in FIG. 1. The U-shaped heating element 20 and the pair of lead portions 21 and 22 are made of a resistive ceramic material. Insulating coating layers 23 and 24 as insulating layers are respectively formed on the surfaces of the lead portions 21 and 22 and are fitted in the distal end portion of the holder 12 through these layers 23 and 24. One lead portion 21 is connected to the external connecting terminal 14 which is kept insulated from the rear end portion of the holder 12. The other lead portion 22 is grounded on the holder 12 side through a metal wire 31, fitted on bushing 13, connected to a terminal piece 30 which extends from the metal pipe 13*a* fitted on bushing 13. A current path of this glow plug 10 is constituted by the external connecting terminal 14, the terminal piece 14*a*, the metal wire 15, the lead portion 21 of the ceramic heater 11, the heating element 20, the lead portion 22, the metal wire 31, the terminal piece 30, the metal pipe 13*a*, and the holder 12.

More specifically, according to the present invention, the ceramic heater 11 comprises the heating element 20 made of a resistive ceramic member having a thickness smaller than that of the lead portions 21 and 22. A longitudinal slit 25 is formed at the central portion of the ceramic heater 11 from the heating element 20 to the lead portions 21 and 22. An insulating sheet 26 made of, e.g., an insulating ceramic material, is mounted in the rear end portion of the slit 25 corresponding to at least the distal end portion of the holder 12 and between the lead portions 21 and 22. The insulating sheet 26 is integrally bonded to the lead portions 21 and 22 made of a resistive ceramic material, thereby sealing the slit 25 at the distal end portion of the holder 12. Therefore, leakage of a combustion pressure and combustion heat can be properly prevented.

The insulating coating layers 23 and 24 are formed on the central surfaces of the lead portions 21 and 22 formed integrally with the heating element 20 of a resistive ceramic material. The ceramic heater 11 is brazed with silver at the distal end portion of the holder 12 through the silver-palladium layers respectively formed on the layers 23 and 24. In this case, the mating surface portions of the holder 12 may be provided with silver-palladium layers. However, these layers need not be formed on the mating surface portions.

Metallized layers 27 serving as electrode extraction terminals 21*a* and 22*a* are formed on the outer surfaces of rear end portions of the lead portions 21 and 22. Distal end portions of the metal wires 15 and 31 are brazed to the electrode extraction terminals 21*a* and 22*a* through terminal caps 28 and 29, respectively. Therefore, one of the lead portions 21 and 22 is anode-connected to the external connecting terminal 14, and the other lead portion is grounded on the holder 12 side. The heating element 20 can thus be energized.

According to the glow plug having the arrangement described above, electrode extraction from the ceramic heater 11 can be performed from the rear end portions of the lead portions 21 and 22 within the holder 12. The insulating coating layers 23 and 24 as insulating layers can have a uniform thickness on the entire brazing surface portions in which the lead portions 21 and 22 of the heater 11 are fitted in the distal end portion of the holder 12. The insulating layers can be easily formed, and the heater 11 can be coaxially brazed to the holder 12 with high precision. In addition, unlike in the conventional glow plug, an electrical conductivity and the like are not required for the brazed portion, and only simple mechanical coupling is required. Therefore, reliability of adhesion strength can be improved, and the quality of the brazed portion can be uniform.

According to the bipolar ceramic heater 11, the electrode extraction portions 21*a* and 22*a* are located in the holder 12 and are located away from the heating element 20. The electrode extraction portions can be maintained at a relatively low temperature. Therefore, reliability such as heat resistance can be improved as compared with the conventional arrangement.

The terminal caps 28 and 29 mounted on the electrode extraction terminals 21*a* and 22*a* are firmly bonded to the ceramic heater 11 side by coating a nickel paste on the metallized layers 27 and baking at a high temperature (e.g., about 1,200° C.). The terminal caps 28 and 29 have the same shapes as that of the electrode extraction terminals 21*a* and 22*a* at the rear end portion of the heater 11. At the same time, the terminal caps 28 and 29 are coupled by silver brazing or the like while being fitted on the electrode extraction terminals 21*a* and 22*a*, respectively. The metal wires 15 and 31 led from the caps 28 and 29 are welded to the external connecting terminal 14 and the terminal piece 30 on the holder 12 side by spot welding, respectively.

The ceramic heater 11 is injection-molded using a resistive ceramic paste in a mold and is baked to form a desired shape. Alternatively, a rod-like ceramic heater may be machined to have a desired shape according to discharge machining. After molding or machining, the insulating coating layers 23 and 24 (these layers are preferably formed by flame spraying using alumina or the like) and the metallized layers 27 are respectively formed on the surfaces of the corresponding lead portions 21 and 22 and the electrode extraction terminals 21a and 22a. In addition, silver-palladium layers as auxiliary bonding members are formed on the lead portions and the electrode extraction terminals, thereby bonding these portions and these terminals to the metal holder 12.

A resistive ceramic material constituting a substantially U-shaped ceramic heater 11 is SiAlON obtained by controlling a mixing ratio of titanium nitride (TiN) with a SiAlON containing $\beta$-phase SiAlON (88% of $Si_3N_4$, 5% of $Al_2O_3$, and 7% of $Y_2O_3$) or $\alpha+\beta$-phase SiAlON. It is found that an electrical conductivity of positive resistance-temperature characteristics can be obtained (i.e., a resistive SiAlON) when about 20% or more of TiN is added to the SiAlON. When the content of TiN is added exceeding this range, the resistivity of the resultant SiAlON is known to be continuously changed. Therefore, a SiAlON compound containing a predetermined content of TiN as described above can be used as needed. However, the resistive ceramic material serving as the ceramic heater 11 is not limited to the above-mentioned SiAlON. It is therefore essential to use a ceramic material whose performance is stable at high temperatures (e.g., up to 1,200° C.) and a good property such as a good resistance. At least one nonoxide conductive material selected from the group consisting of SiC, and a carbonate, a borate, a nitride, or a carbonitride of an element of the Group IVa, Va, and VIa of the Periodic Table is mixed with Al or an Al compound as a sintering binder to prepare a SiAlON sintered body.

According to the ceramic heater 11 obtained as described above, the heating element 20 does not contain a foreign material and serves as a surface heating type element. Therefore, the ceramic heater has a high heat resistance and a fast heating function. In addition, the content of titanium nitride can be adjusted to control a resistivity of the resistive SiAlON. Therefore, the thickness of the heating element 20 and the pair of lead portions 21 and 22 can be arbitrarily determined, and particularly, the width (sectional area) of the heating element 20 can be reduced, thereby obtaining a good fast heating property. A saturation temperature of the heating element 20 can be properly controlled to perform after glow operation for a long period of time. In particular, the above-mentioned resistive SiAlON has a positive resistance-temperature coefficient and can be advantageously used from the viewpoint of self temperature saturation properties.

A preferable insulating ceramic material for forming the above insulating sheet 26 is SiAlON which is prepared by controlling the content of titanium nitride (TiN) to obtain desired insulating and conductive properties in the same manner as the resistive ceramic material as that of the ceramic heater 11. When such a material is selected, the thermal expansion coefficient of the insulating sheet 26 can be substantially equal to that of the resistor side, and their bonding strength can be increased. Therefore, reliability of heat resistance and the like can be improved. However, other preferable insulating ceramic materials having high heat resistance and high bonding strength with the resistive ceramic material are materials containing $Si_3N_4$, AlN, or $Al_2O_3$ as a major constituent. It is also preferable to use glass or the like as an insulating material.

Figure 2B:
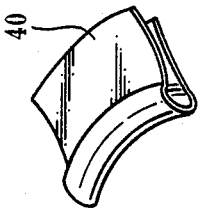
FIGS. 2*a* and 2*b* are a schematic sectional view and a schematic perspective view, respectively, showing another embodiment of the present invention.
Figure 2A:
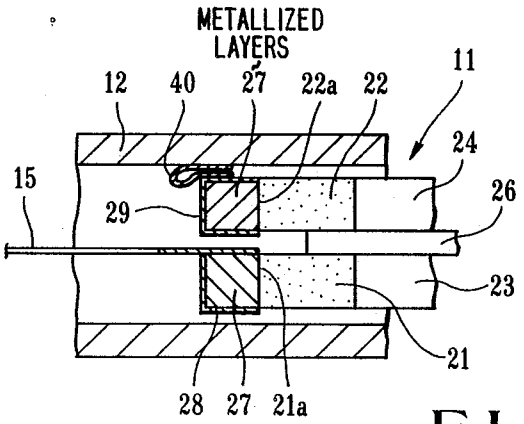

The present invention is not limited to the particular embodiment described above. The shapes and structures of the respective components of the glow plug 10 can be arbitrarily changed and modified. In the above embodiment, when the other lead portion 22 is to be grounded on the holder 12 side, the terminal piece 30 extending from the insulating bushing 13 through the metal pipe 13a is utilized. However, the present invention is not limited to this arrangement. The metal wire extending 31 from the terminal cap 29 may be welded or brazed to the inner wall portion, of the holder 12. Alternatively, as shown in FIGS. 2a and 2b, a bonding metal piece 40 or the like obtained by bending a conductive leaf spring may be inserted between the terminal cap 29 and the inner wall portion of the holder 12. In addition, the outer surface of the terminal cap 29 may be directly brazed on the inner wall portion of the holder 12. Furthermore, without using the terminal cap 29, the electrode extraction terminal 22a of the lead portion 22 may be directly connected to the holder 12 side by a connecting metal piece or brazing.

According to the present invention as described above, the U-shaped heating element and the pair of parallel lead portions extending backward from the both ends of the U-shaped heating element are integrally formed of a resistive ceramic material to constitute a rod-like ceramic heater. In addition, the surfaces of the lead portions are held by the distal end portion of the holder through the corresponding insulating layers. One lead portion is connected to the external connecting terminal which is kept insulated at the rear end portion of the holder, and the other lead portion is grounded on the holder side. Although the arrangement is simple and inexpensive, the ceramic heater can be easily and suitably held by the distal end portion of the holder. In addition, the heater element can be coaxially held by the holder, and their bonding portion can be highly reliably obtained. Moreover, in the ceramic heater according to the present invention, since the heating element is exposed on the surface of the heater, the heater tip can be quickly heated, thus providing a fast heating type heater. The heat capacity of the heating element can be reduced by the resistive ceramic material to obtain a good self temperature saturation property, thereby properly controlling the saturation temperature and achieving a long-term after glow operation which can effectively reduce an engine exhaust gas and noise.

What is claimed is:

1. A glow plug for a diesel engine, comprising:

an elongated hollow electrically conductive holder;

a rod-like ceramic heater held at a distal end of said hollow holder such that one end of said rod-like ceramic heater extends outside;

an external connecting terminal positioned in the other end of said hollow holder;

an insulating member for electrically insulating said external connecting terminal from said hollow holder; and a metal pipe positioned between an inner surface of the other end of said hollow holder and said insulating member;

said ceramic heater comprising a U-shaped heating element and a pair of parallel lead portions extending backward from both ends of said U-shaped heating element, said U-shaped heating element and said pair of parallel lead portions being made of a resistive ceramic material and being arranged such that outer surfaces of said lead portions are held by the distal end of said holder through electrical insulating layers between the inner surface of said holder and the outer surface of said lead portions, rear end portions of said lead portions constituting electrode extraction ends and being separated from said holder in said holder, the electrode extraction end of one lead portion being electrically connected to said external connecting terminal through a conductive material, and said electrode extraction end of the other lead portion being electrically connected to said metal pipe, said metal pipe being electrically connected to said holder.

2. A plug according to claim 1, wherein said U-shaped heating element is arranged such that a thickness of at least a distal end portion thereof is smaller than that of said lead portions.

3. A plug according to claim 1, wherein said electrical insulating layers are respectively formed on the outer surfaces of said lead portions held by said holder.

4. A plug according to claim 1, wherein the electrode extraction ends of said lead portions extending inside said holder are formed with metallized layers, respectively.

5. A plug according to claim 4, wherein said metallized layers are covered with electrically conductive terminal caps, respectively.

6. A plug according to claim 1, wherein an electrical insulating sheet is formed on a portion of said, ceramic, heater at the distal end portion of said holder to seal the gap between said lead portions.

7. A plug according to claim 6, wherein said electrical insulating layers are formed on the entire circumferential surfaces of said lead portions.

8. A plug according to claim 1, wherein said ceramic heater is integrally formed of a ceramic material prepared such that titanium nitride is added to a $\beta$-phase SiAlON or an $\alpha+\beta$-phase SiAlON to select desired insulating and conductive properties.

* * * * *